US011286946B2

(12) United States Patent
Wang et al.

(10) Patent No.: US 11,286,946 B2
(45) Date of Patent: Mar. 29, 2022

(54) WIND WHEEL AND FAN COMPRISING THE SAME

(71) Applicant: Zhongshan Broad-Ocean Motor Co., Ltd., Zhongshan (CN)

(72) Inventors: Hongbin Wang, Zhongshan (CN); Fengqi Wang, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 257 days.

(21) Appl. No.: 16/702,496

(22) Filed: Dec. 3, 2019

(65) Prior Publication Data

US 2020/0102965 A1 Apr. 2, 2020

Related U.S. Application Data

(63) Continuation-in-part of application No. PCT/CN2019/076279, filed on Feb. 27, 2019.

(30) Foreign Application Priority Data

Sep. 1, 2018 (CN) ..... 201821429072.8

(51) Int. Cl.
*F04D 29/32* (2006.01)
*F04D 19/00* (2006.01)
(Continued)

(52) U.S. Cl.
CPC ..... *F04D 29/325* (2013.01); *F04D 19/002* (2013.01); *F04D 29/384* (2013.01); *F04D 29/403* (2013.01); *F05D 2240/303* (2013.01)

(58) Field of Classification Search
CPC .... F04D 29/325; F04D 29/384; F04D 29/403; F04D 29/406; F04D 29/386; F04D 19/02; F05D 2240/303; F05D 2240/305
See application file for complete search history.

(56) References Cited

U.S. PATENT DOCUMENTS

2004/0253103 A1* 12/2004 Iwase ..... F04D 29/545 415/220
2015/0330223 A1* 11/2015 Choi ..... F01D 5/025 416/204 R

FOREIGN PATENT DOCUMENTS

CN 108302065 A 7/2018
CN 108386384 A 8/2018
(Continued)

OTHER PUBLICATIONS

Shigemori, WO2015146013—Propeller Fan for Electric Fan, and Electric Fan—English Translation , 2015 (Year: 2015).*
JP2001227497AMT-Desc-en—English Translation, 2001 (Year: 2001).*

*Primary Examiner* — Kenneth J Hansen
(74) *Attorney, Agent, or Firm* — Matthias Scholl P.C.; Matthias Scholl

(57) ABSTRACT

A wind wheel including a plurality of blades and a hub. The plurality of blades each includes an inner edge, an outer edge, a leading edge, and a trailing edge. In a top view of the orthographic projection of the wind wheel, the maximum distance between the center O of the hub and the outer edge of the plurality of blades refers to the outer diameter R; the distance between the center O and the cross point A1 of the inner edge and the leading edge is named R1; the outer edge is connected to the leading edge via an arc; the distance between the center O and a joint A2 of the arc and the leading edge is named R2; and the distances R1, R2, and the outer diameter R satisfy the following conditions: 0.35R≤R1≤0.45R; 0.8R≤R2≤0.9R.

14 Claims, 6 Drawing Sheets

(51) Int. Cl.
*F04D 29/40* (2006.01)
*F04D 29/38* (2006.01)

(56) References Cited

FOREIGN PATENT DOCUMENTS

| | | | |
|---|---|---|---|
| JP | 09287595 | A | 11/1997 |
| JP | 2001227497 | A | 8/2001 |
| JP | 2013130096 | A | 7/2013 |

* cited by examiner

WIND WHEEL AND FAN COMPRISING THE SAME

CROSS-REFERENCE TO RELATED APPLICATIONS

This application is a continuation-in-part of International Patent Application No. PCT/CN2019/076279 with an international filing date of Feb. 27, 2019, designating the United States, now pending, and further claims foreign priority benefits to Chinese Patent Application No. 201821429072.8 filed Sep. 1, 2018. The contents of all of the aforementioned applications, including any intervening amendments thereto, are incorporated herein by reference. Inquiries from the public to applicants or assignees concerning this document or the related applications should be directed to: Matthias Scholl P C., Attn.: Dr. Matthias Scholl Esq., 245 First Street, 18th Floor, Cambridge, Mass. 02142.

BACKGROUND

The disclosure relates to a wind wheel and a fan comprising the wind wheel.

Conventionally, a wind wheel includes a plurality of blades and a hub. The plurality of blades each includes an inner edge and an outer edge with respect to the hub, a leading edge, and a trailing edge. The inner edge is directly connected to the hub. The inner edge, the outer edge, the leading edge, and the trailing edge are connected sequentially to each other to form a pressure surface and a suction surface of each blade. Every two adjacent blades form an air duct. The shape and the radial length of the blades and the deflection angle of the pressure surface with respect to the end face of the hub all affect the air volume of the air duct.

SUMMARY

Provided is a wind wheel comprising a plurality of blades and a hub. The plurality of blades each comprises an inner edge and an outer edge with respect to the hub, a leading edge, and a trailing edge; and the inner edge is directly connected to the hub; the inner edge, the outer edge, the leading edge, and the trailing edge are connected sequentially to each other to form a pressure surface and a suction surface of each blade; in a top view of the orthographic projection of the wind wheel, the maximum distance between the center O of the hub and the outer edge of one of the plurality of blades refers to an outer diameter R of the plurality of blades; the distance between the center O of the hub and the cross point A1 of the inner edge and the leading edge is named R1; the outer edge is connected to the leading edge via an arc; the distance between the center O of the hub and a joint A2 of the arc and the leading edge is named R2; and the distance R1, R2, and the outer diameter R satisfy the following conditions: $0.35R \le R1 \le 0.45R$; $0.8R \le R2 \le 0.9R$.

The distance R2 and the outer diameter R satisfy the following conditions: $0.85R \le R2 \le 0.87R$; make a circle with the center O as a center and the distance R2 as a radius, the cross point of the circle and the trailing edge is named A3, the included angle $\alpha$ between the line OA2 and the line OA3 satisfies the following condition: $65° \le \alpha \le 66°$; and the longest connection segment A2A3 on the blade is along the circumference of the circle.

The cross point of the trailing edge and the inner edge is named A4, the included angle $\beta$ between the line OA1 and the line OA4 satisfies the following condition: $61.5° \le \beta \le 62.5°$.

The included angle $\gamma$ between the line OA1 and the line OA2 satisfies the following condition: $29.5° \le \gamma \le 30.5°$.

In the pressure surface, the included angle $\delta$ between the connection line of the cross point A1 and the cross point A2 and the end face of the hub satisfies the following condition: $16° \le \delta \le 17.2°$.

The plurality of blades is four in number.

Also provided is a fan comprising: a motor, the aforesaid wind wheel, a current collector, and a mesh enclosure; the wind wheel, the current collector, and the mesh enclosure are disposed on the motor.

The wind wheel has improved structural parameters, and can produce much more air speed and wind power than conventional products.

DETAILED DESCRIPTIONS

Figure 1:
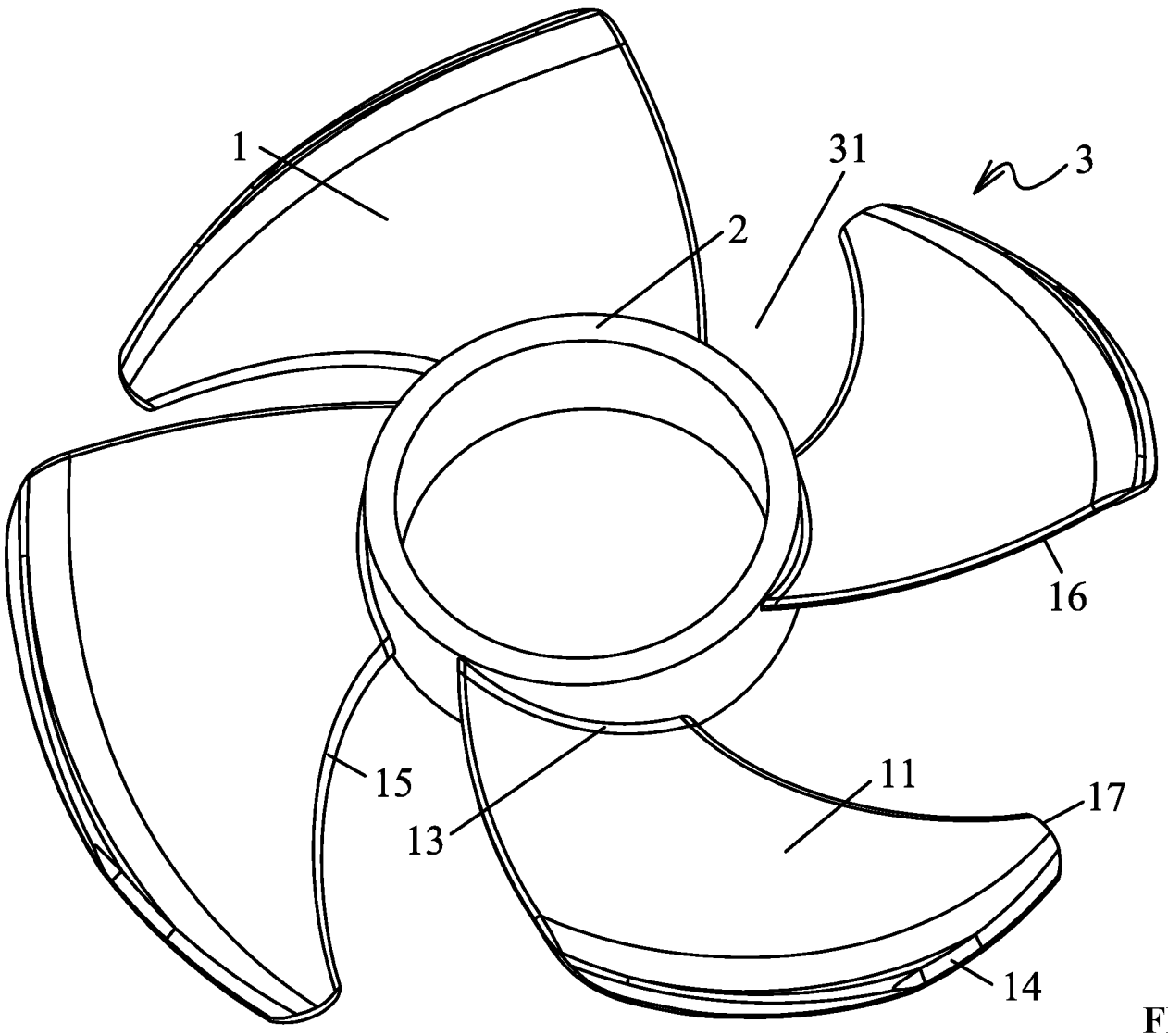
FIG. 1 is a schematic diagram of a wind wheel according to one embodiment of the disclosure.
Figure 2:
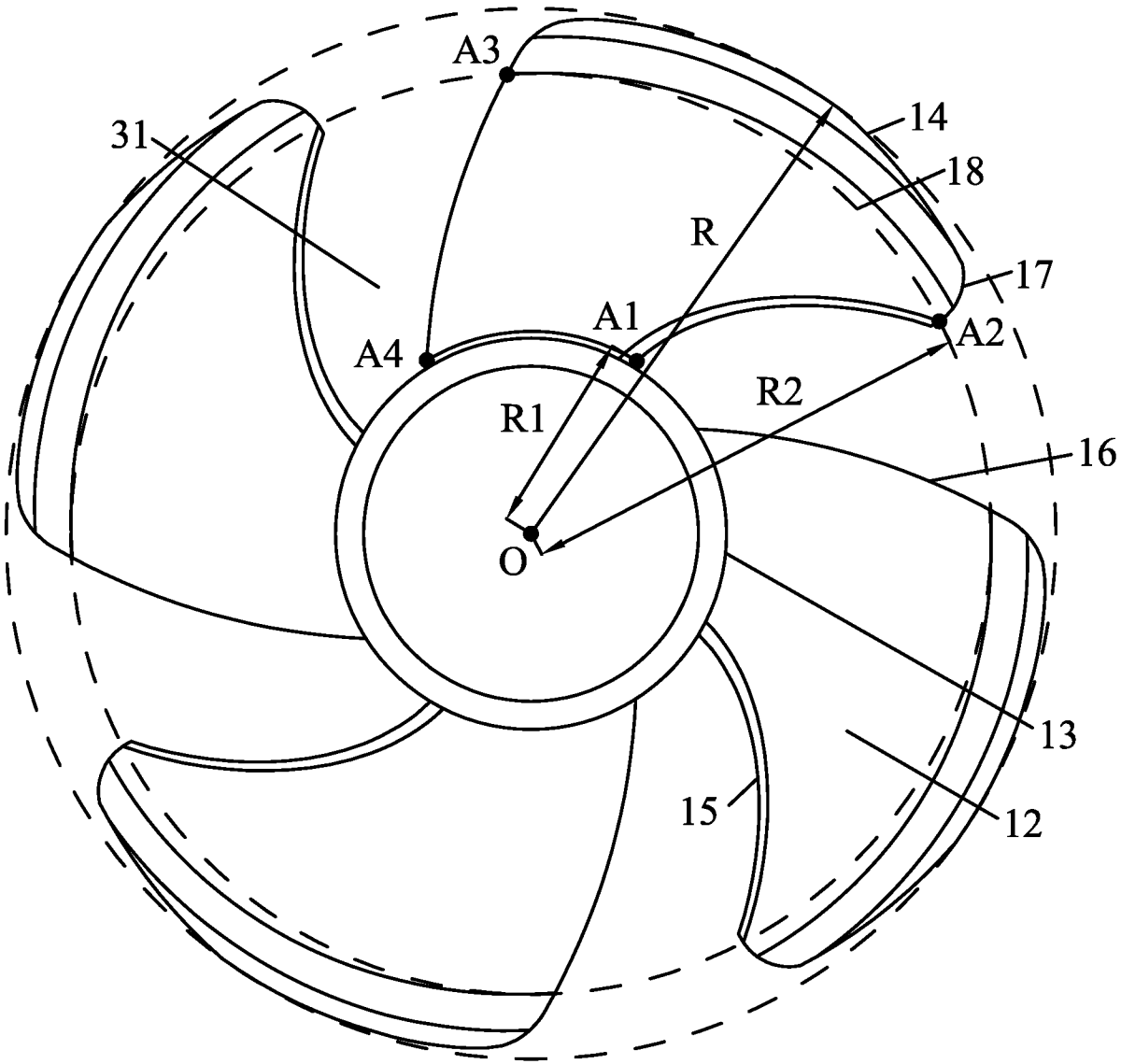
FIG. 2 is a top view of a wind wheel according to one embodiment of the disclosure.
Figure 3:
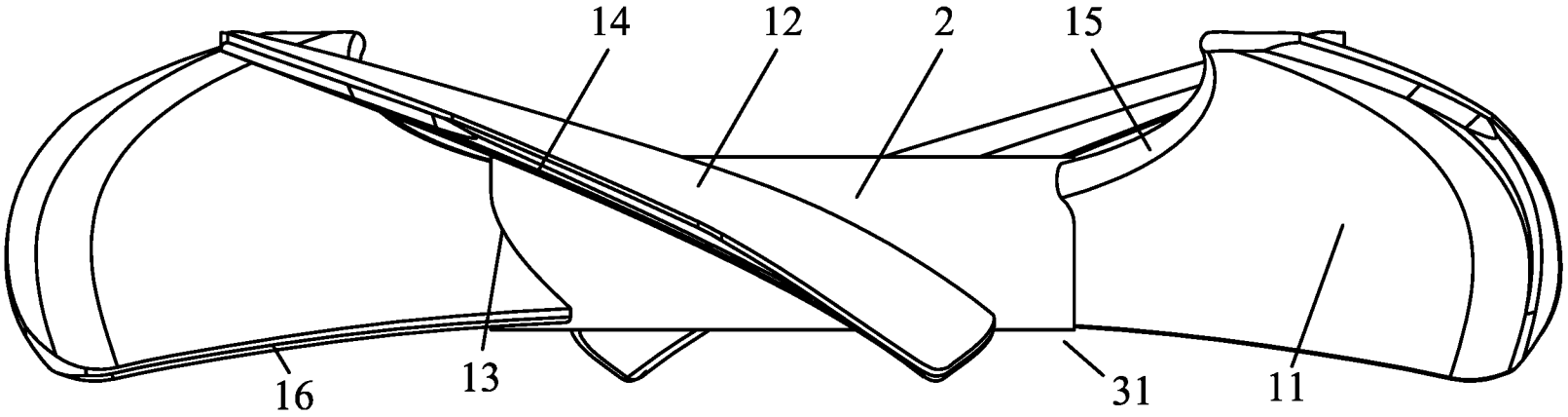
FIG. 3 is a front view of a wind wheel according to one embodiment of the disclosure.
Figure 4:
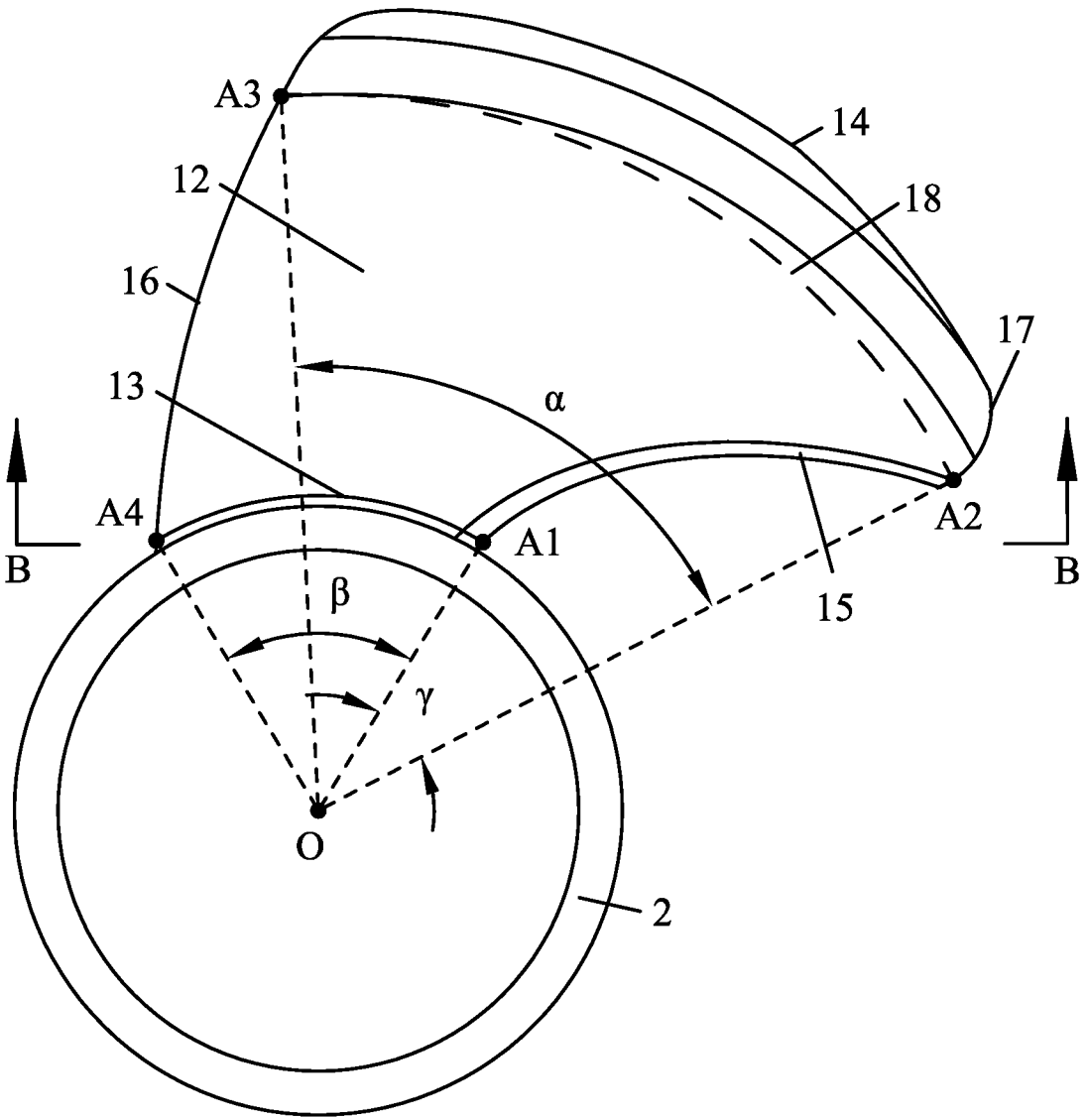
FIG. 4 is a stereogram of a wind wheel according to one embodiment of the disclosure.
Figure 5:
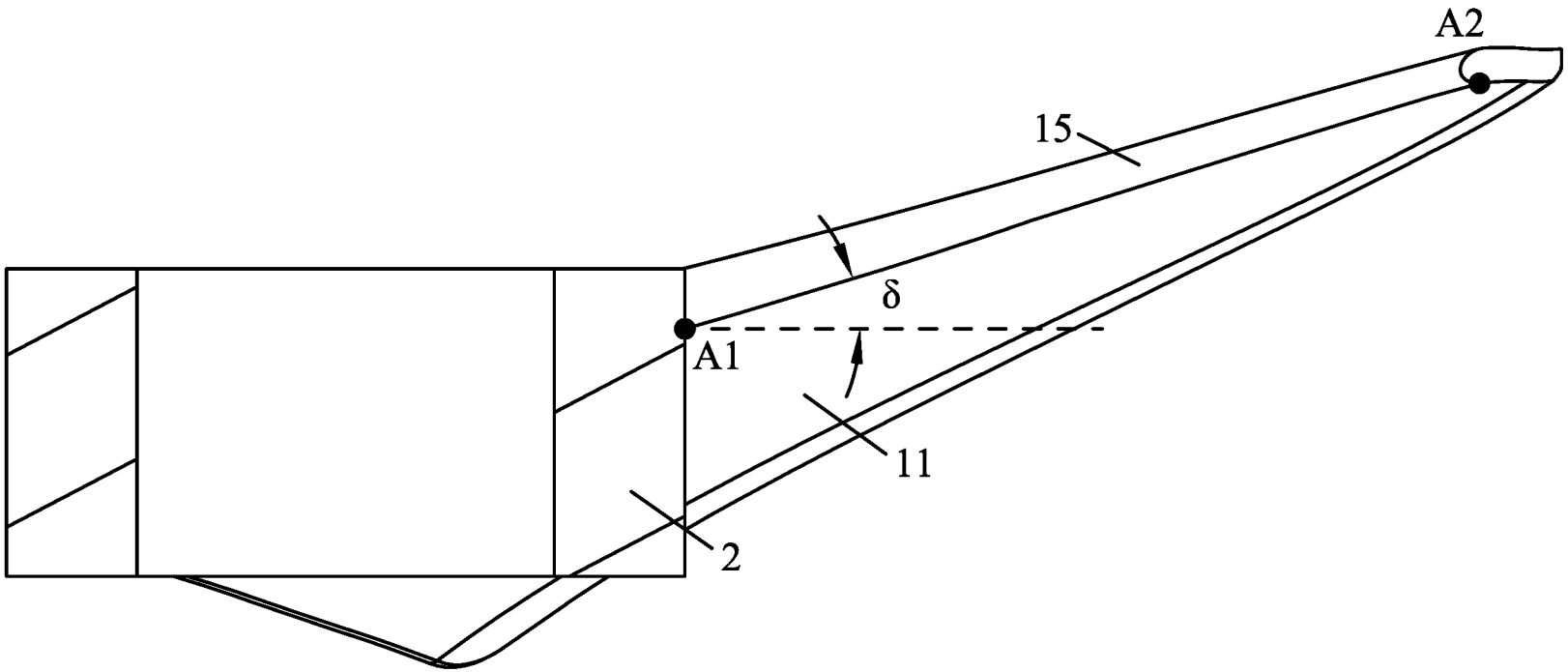
FIG. 5 is a sectional view taken from line B-B in FIG. 4.

To further illustrate, embodiments detailing a wind wheel and a motor comprising the same are described below. It should be noted that the following embodiments are intended to describe and not to limit the disclosure.

EXAMPLE 1

As shown in FIGS. 1-5, a wind wheel comprises a hub 2 and a plurality of blades 1. The plurality of blades 1 each comprises an inner edge 13 and an outer edge 14 with respect to the hub, a leading edge 15, and a trailing edge 16; and the inner edge is directly connected to the hub 2; the inner edge 13, the outer edge 14, the leading edge 15, and the trailing edge 16 are connected sequentially to each other to form a pressure surface 11 and a suction surface 12 of each blade. Every two adjacent blades form an air duct 31.

In a top view of the orthographic projection of the wind wheel, the maximum distance between the center O of the hub 2 and the outer edge 14 of one of the plurality of blades 1 refers to the outer diameter R of the plurality of blades 1; the distance between the center O of the hub 2 and the cross point A1 of the inner edge 13 and the leading edge 15 is named R1; the outer edge 14 is connected to the leading edge 15 via an arc 17; the distance between the center O of the hub 2 and a joint A2 of the arc 17 and the leading edge 15 is named R2; and the distance R1, R2, and the outer diameter R satisfy the following conditions: $0.35R \le R1 \le 0.45R$; $0.8R \le R2 \le 0.9R$.

The distance R2 and the outer diameter R satisfy the following conditions: $0.85R \le R2 \le 0.87R$; make a circle 18 with the center O as a center and the distance R2 as a radius, the cross point of the circle 18 and the trailing edge 16 is named A3, the included angle $\alpha$ between the line OA2 and the line OA3 satisfies the following condition: $65° \le \alpha \le 66°$;

and the longest connection segment A2A3 on the blade 1 is along the circumference of the circle 18.

The cross point of the trailing edge 16 and the inner edge 13 is named A4, the included angle β between the line OA1 and the line OA4 satisfies the following condition: 61.5°≤β≤62.5°.

The included angle γ between the line OA1 and the line OA2 satisfies the following condition: 29.5°≤γ≤30.5°.

In the pressure surface 11, the included angle δ between the connection line of the cross point A1 and the cross point A2 and the end face of the hub 2 satisfies the following condition: 16°≤δ≤17.2°.

The plurality of blades 1 is four in number.

EXAMPLE 2

Figure 6:
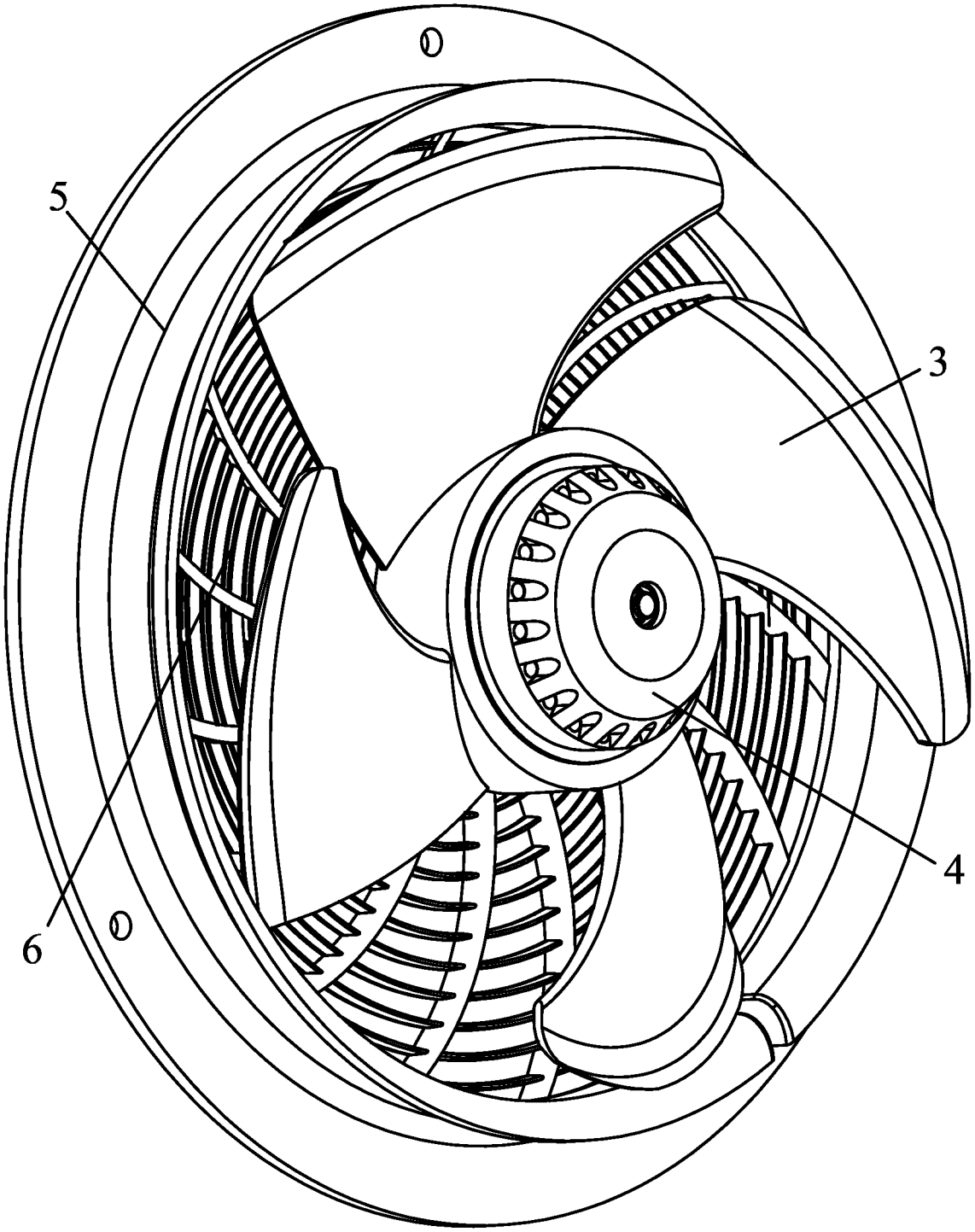
FIG. 6 is a schematic diagram of a wind wheel according to another embodiment of the disclosure.

As shown in FIG. 6, a fan comprises a motor 4, a wind wheel 3 in Example 1, a current collector 5, and a mesh enclosure 6, and the wind wheel 3, the current collector 5, and the mesh enclosure 6 are disposed on the motor 4.

It will be obvious to those skilled in the art that changes and modifications may be made, and therefore, the aim in the appended claims is to cover all such changes and modifications.

What is claimed is:

1. A wind wheel, comprising:

1) a plurality of blades; and 2) a hub;

wherein:

the plurality of blades each comprises an inner edge and an outer edge with respect to the hub, a leading edge, and a trailing edge; and the inner edge is directly connected to the hub;

the inner edge, the outer edge, the leading edge, and the trailing edge are connected sequentially to each other to form a pressure surface and a suction surface of each blade;

in a top view of an orthographic projection of the wind wheel, a maximum distance between a center O of the hub and the outer edge of one of the plurality of blades refers to an outer radius R of the plurality of blades;

a distance between the center O of the hub and a cross point A1 of the inner edge and the leading edge is named R1;

the outer edge is connected to the leading edge via an arc;

a distance between the center O of the hub and a joint A2 of the arc and the leading edge is named R2;

the distance R1, R2, and the outer radius R satisfy the following conditions: 0.35R≤R1≤0.45R; 0.85R≤R2≤0.87R;

a cross point of a circle and the trailing edge is named A3, wherein the circle has the center O as a center and the distance R2 as a radius; an included angle α between the line OA2 and the line OA3 satisfies the following condition: 65°≤α≤66°; and a longest connection segment A2A3 on the blade is along a circumference of the circle.

2. The wind wheel of claim 1, wherein a cross point of the trailing edge and the inner edge is named A4, an included angle β between the line OA1 and the line OA4 satisfies the following condition: 61.5°≤β≤62.5°.

3. The wind wheel of claim 2, wherein an included angle γ between the line OA1 and the line OA2 satisfies the following condition: 29.5°≤γ≤30.5°.

4. The wind wheel of claim 3, wherein in the pressure surface, an included angle δ between a connection line of the cross point A1 and the cross point A2 and an end face of the hub satisfies the following condition: 16°≤δ≤17.2°.

5. The wind wheel of claim 4, wherein the plurality of blades is four in number.

6. The wind wheel of claim 2, wherein in the pressure surface, an included angle δ between a connection line of the cross point A1 and the cross point A2 and an end face of the hub satisfies the following condition: 16°≤δ≤17.2°.

7. The wind wheel of claim 6, wherein the plurality of blades is four in number.

8. The wind wheel of claim 1, wherein in the pressure surface, an included angle δ between a connection line of the cross point A1 and the cross point A2 and an end face of the hub satisfies the following condition: 16°≤δ≤17.2°.

9. The wind wheel of claim 8, wherein the plurality of blades is four in number.

10. A fan, comprising: a motor, the wind wheel of claim 1, a current collector, and a mesh enclosure; wherein the wind wheel, the current collector, and the mesh enclosure are disposed on the motor.

11. The fan of claim 10, wherein a cross point of the trailing edge and the inner edge is named A4, an included angle β between the line OA1 and the line OA4 satisfies the following condition: 61.5°≤β≤62.5°.

12. The fan of claim 11, wherein an included angle γ between the line OA1 and the line OA2 satisfies the following condition: 29.5°≤γ≤30.5°.

13. The fan of claim 12, wherein in the pressure surface, an included angle δ between a connection line of the cross point A1 and the cross point A2 and an end face of the hub satisfies the following condition: 16°≤δ≤17.2°.

14. The fan of claim 13, wherein the plurality of blades is four in number.

* * * * *